US010240893B2

(12) United States Patent
Henderson et al.

(10) Patent No.: US 10,240,893 B2
(45) Date of Patent: Mar. 26, 2019

(54) RIFLE MAGAZINE WITH STORAGE CONTAINER

(71) Applicant: GY6 LLC, Peoria, AZ (US)

(72) Inventors: Kyle L. Henderson, Peoria, AZ (US); Eric J. Malone, Buckeye, AZ (US); Michael N. Guttridge, Dixon, CA (US)

(73) Assignee: GY6 LLC, Peoria, AZ (US)

( * ) Notice: Subject to any disclaimer, the term of this patent is extended or adjusted under 35 U.S.C. 154(b) by 0 days.

(21) Appl. No.: 15/988,462

(22) Filed: May 24, 2018

(65) Prior Publication Data

US 2018/0364003 A1 Dec. 20, 2018

Related U.S. Application Data

(60) Provisional application No. 62/519,243, filed on Jun. 14, 2017.

(51) Int. Cl.
*F41C 23/22* (2006.01)
*F41A 9/65* (2006.01)

(52) U.S. Cl.
CPC ..... *F41C 23/22* (2013.01); *F41A 9/65* (2013.01)

(58) Field of Classification Search
CPC ..... F41A 9/61; F41A 9/64; F41A 9/65; F41A 9/71
USPC ..... 42/50, 49.01, 49.02
See application file for complete search history.

(56) References Cited

U.S. PATENT DOCUMENTS 3,191,332 A * 6/1965 Ardolino ..... F41A 9/63 42/50
3,964,199 A * 6/1976 Musgrave ..... F16F 1/22 42/50
4,139,958 A * 2/1979 Foote ..... F41A 9/71 42/49.02
4,685,238 A * 8/1987 Schoepflin ..... F16B 5/0004 42/90
4,936,037 A * 6/1990 Holcomb ..... F41A 9/65 340/539.1
4,996,787 A * 3/1991 Holcomb ..... F41A 9/65 42/106
5,113,605 A * 5/1992 Kim ..... F41A 9/71 42/50
5,557,872 A * 9/1996 Langner ..... F41C 23/22 362/114
5,568,696 A * 10/1996 Mauch ..... F41A 9/71 42/49.02

(Continued)

*Primary Examiner* — Joshua E Freeman
(74) *Attorney, Agent, or Firm* — Bennet K. Langlotz; Langlotz Patent & Trademark Works, LLC

(57) ABSTRACT

Rifle magazines with storage containers have a first elongated tubular body defining an ammunition passage, the first elongated tubular body having an upper end defining an ammunition feed aperture, the first elongated tubular body having a lower end having a first floor plate attachment facility, a magazine spring and follower contained in the ammunition passage, a floor plate having a first attachment feature adapted to connect to the first floor plate attachment facility, a second elongated tubular body defining a storage passage, the second elongated tubular body having an upper end having a second floor plate attachment facility, and the floor plate having a second attachment feature adapted to connect to the second floor plate attachment facility.

15 Claims, 9 Drawing Sheets

(56) References Cited

U.S. PATENT DOCUMENTS

| | | | | |
|---|---|---|---|---|
| 6,446,156 | B1 * | 9/2002 | Chia | G11B 5/012 360/48 |
| 7,032,342 | B2 * | 4/2006 | Pikielny | F41A 9/65 362/110 |
| 8,607,489 | B1 * | 12/2013 | Calvert | F41A 9/71 42/49.01 |
| 9,354,006 | B2 * | 5/2016 | Purkiss | F41A 9/68 |
| 9,631,883 | B2 * | 4/2017 | Grandy | F41A 9/63 |
| 2012/0246988 | A1 * | 10/2012 | Ladner | F41A 9/71 42/49.02 |
| 2013/0255125 | A1 * | 10/2013 | Bath | F41A 9/70 42/50 |
| 2015/0121736 | A1 * | 5/2015 | Faifer | F41A 9/65 42/49.01 |
| 2015/0316340 | A1 * | 11/2015 | Ladner | F41A 9/71 42/49.02 |
| 2016/0003567 | A1 * | 1/2016 | Purkiss | F41A 9/68 42/49.01 |
| 2016/0033220 | A1 * | 2/2016 | Grandy | F41A 9/63 42/49.01 |
| 2017/0321979 | A1 * | 11/2017 | Szczepkowski | F41A 9/71 |
| 2018/0023909 | A1 * | 1/2018 | Ladner | F41A 9/71 42/49.02 |
| 2018/0031342 | A1 * | 2/2018 | Faifer | F41A 9/71 |

* cited by examiner

RIFLE MAGAZINE WITH STORAGE CONTAINER

FIELD OF THE INVENTION

The present invention relates to firearms, and more particularly to a rifle magazine with a storage container.

BACKGROUND OF THE INVENTION

A magazine is an ammunition storage and feeding device within, or attached to, a repeating firearm. The magazine functions by moving the cartridges stored in the magazine into a position where they may be chambered by the action of the firearm. Most magazines designed for use with a reciprocating bolt firearm utilize a set of feed lips which stops the vertical motion of the cartridges out of the magazine but allows one cartridge at a time to be pushed forward (stripped) out of the feed lips by the firearm's bolt into the chamber.

Some form of spring and follower combination is almost always used to feed cartridges to the lips, which can be located either in the magazine (most removable box magazines) or built into the firearm (fixed box magazines). A box (or "stick") magazine, the most popular type of magazine in modern rifles and handguns, stores cartridges in a straight or gently curved column, either one above the other or staggered zigzag fashion. As the firearm cycles, cartridges are moved to the top of the magazine by a follower driven by spring compression to either a single feed position or alternating feed positions. In most firearms, the magazine follower engages a slide-stop to hold the slide back and keep the firearm out of battery when the magazine is empty and all rounds have been fired. Box magazines may be integral to the firearm or removable.

A detachable box magazine is a self-contained mechanism capable of being loaded or unloaded while detached from the host firearm. They are inserted into a magazine well in the firearm receiver usually below the action, but occasionally positioned to the side or on top. When the magazine is empty, it can be detached from the firearm and replaced by another full magazine. This significantly speeds the process of reloading, allowing the operator quick access to ammunition. This type of magazine may be straight or curved, the curve being necessary if the rifle uses rimmed ammunition or ammunition with a tapered case.

Standard capacity magazines for rifles are available in sizes holding 10, 20, and 30 rounds. Magazine pouches to carry spare magazines in these standard capacities are widely available. Magazine pouches are frequently attached to the user's body using a belt or a standard Modular Lightweight Load-carrying Equipment (MOLLE) webbing system to make spare magazines readily available and prevent them from becoming separated from the user.

It is frequently desirable for a survival kit or first aid kit to be readily available to military and law enforcement personnel, as well as hunters. The survival kit or first aid kit should be readily available to the user and difficult to lose. Therefore, a need exists for a new and improved rifle magazine with storage container that contains a survival kit or first aid kit within the storage container. In this regard, the various embodiments of the present invention substantially fulfill at least some of these needs. In this respect, the rifle magazine with storage container according to the present invention substantially departs from the conventional concepts and designs of the prior art, and in doing so provides an apparatus primarily developed for the purpose of providing a survival kit or first aid kit along with a fully functional 10 round rifle magazine.

SUMMARY OF THE INVENTION

The present invention provides an improved rifle magazine with storage container, and overcomes the above-mentioned disadvantages and drawbacks of the prior art. As such, the general purpose of the present invention, which will be described subsequently in greater detail, is to provide an improved rifle magazine with storage container that has all the advantages of the prior art mentioned above.

To attain this, the preferred embodiment of the present invention essentially comprises a first elongated tubular body defining an ammunition passage, the first elongated tubular body having an upper end defining an ammunition feed aperture, the first elongated tubular body having a lower end having a first floor plate attachment facility, a magazine spring and follower contained in the ammunition passage, a floor plate having a first attachment feature adapted to connect to the first floor plate attachment facility, a second elongated tubular body defining a storage passage, the second elongated tubular body having an upper end having a second floor plate attachment facility, and the floor plate having a second attachment feature adapted to connect to the second floor plate attachment facility. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
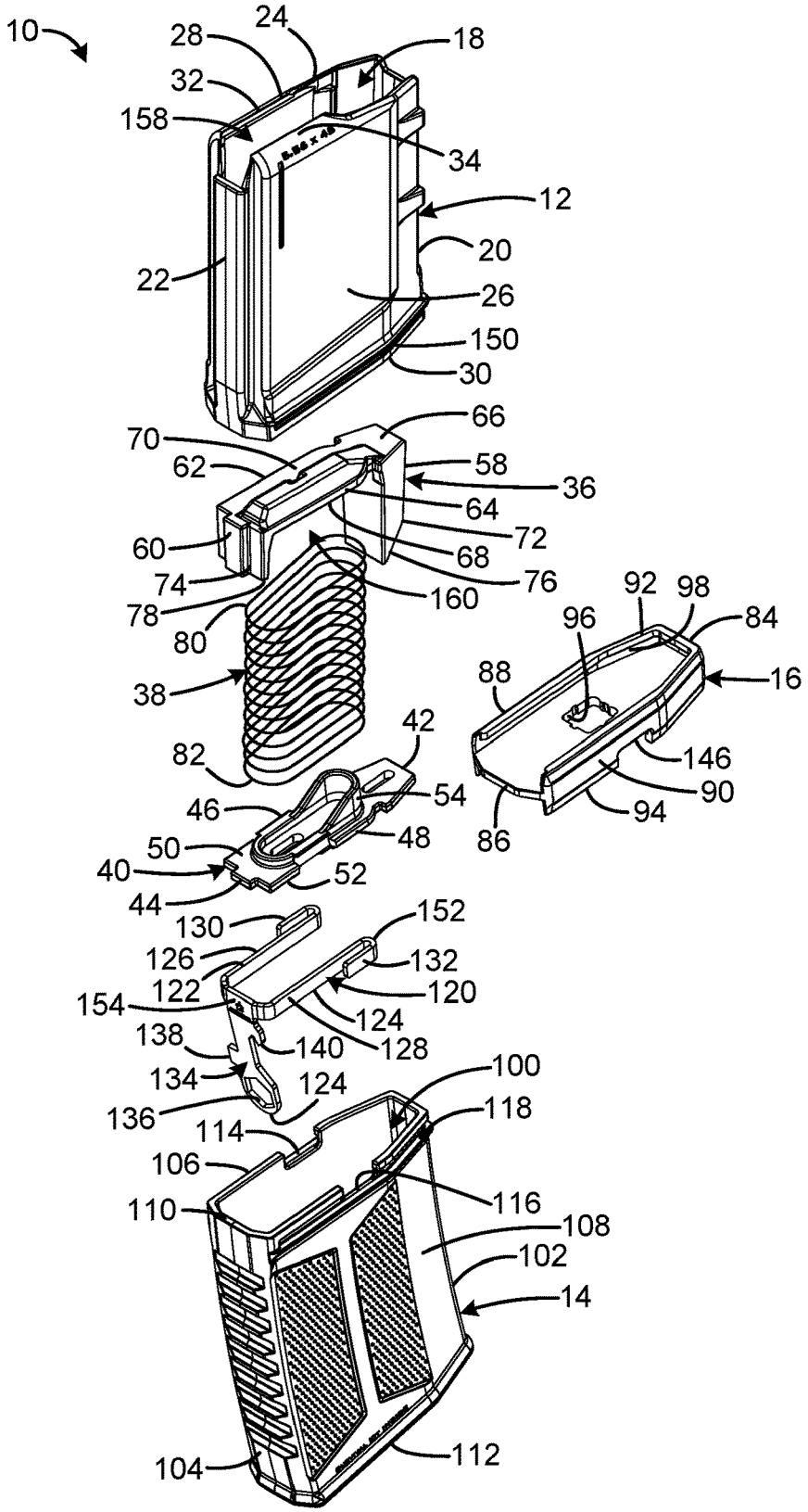
FIG. 1 is an exploded view of the current embodiment of the rifle magazine with storage container constructed in accordance with the principles of the present invention.
Figure 1A:
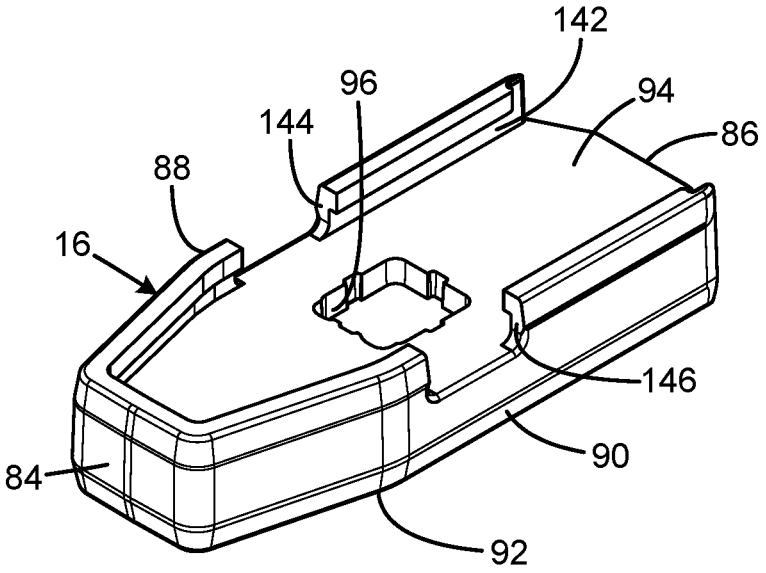
FIG. 1A is a bottom isometric view of the double-sided baseplate of FIG. 1.
Figure 2:
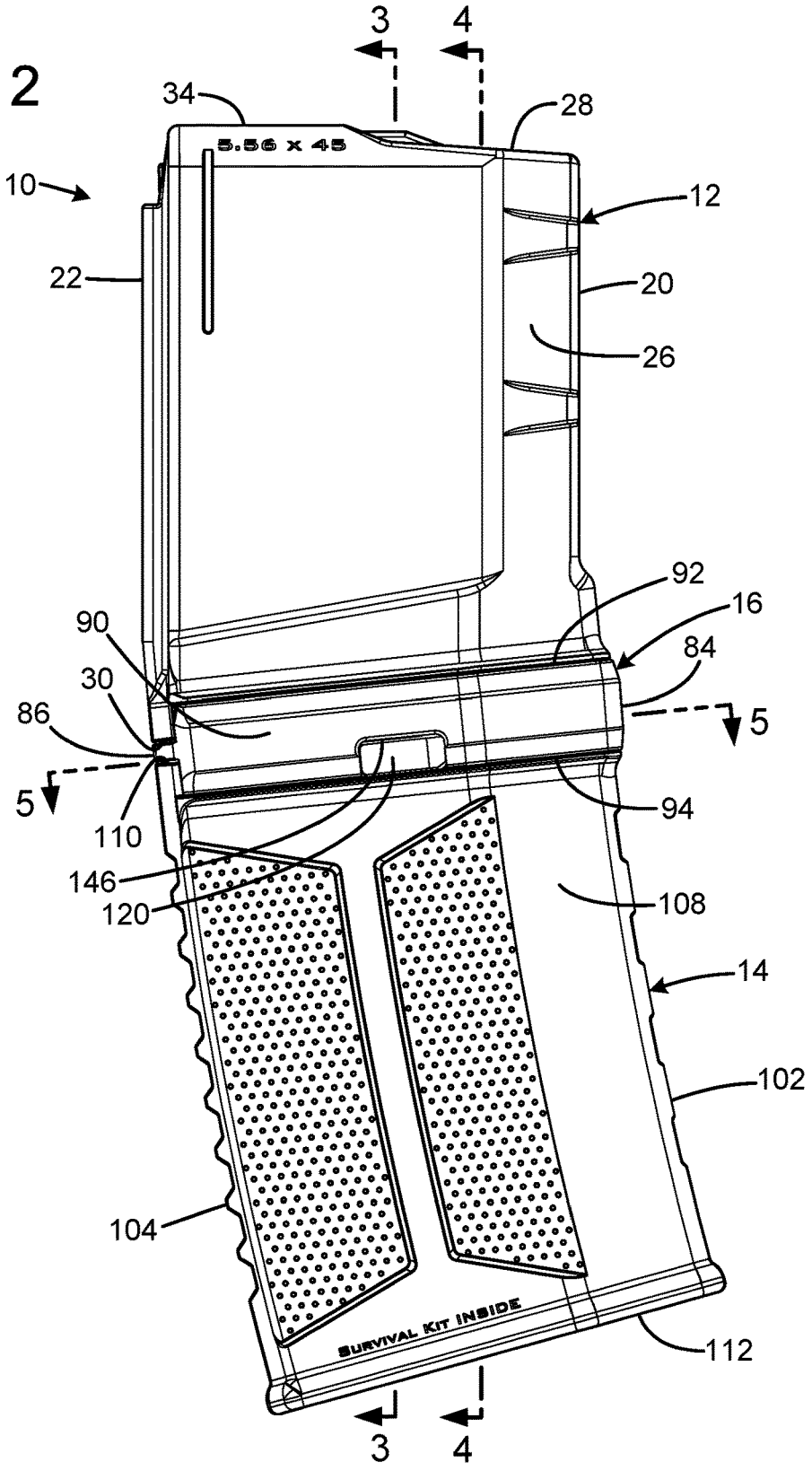
FIG. 2 is a right side view of the rifle magazine with storage container of FIG. 1 with the storage container body attached to the bottom of the double-sided baseplate.
Figure 3:
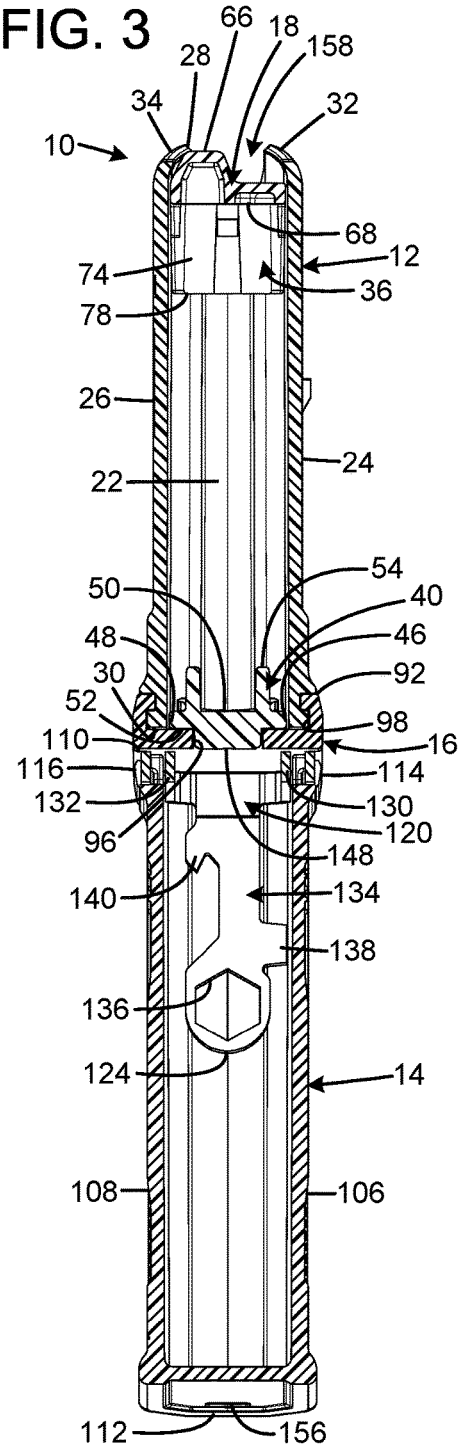
FIG. 3 is a sectional view taken along lines 3-3 of FIG. 2.
Figure 4:
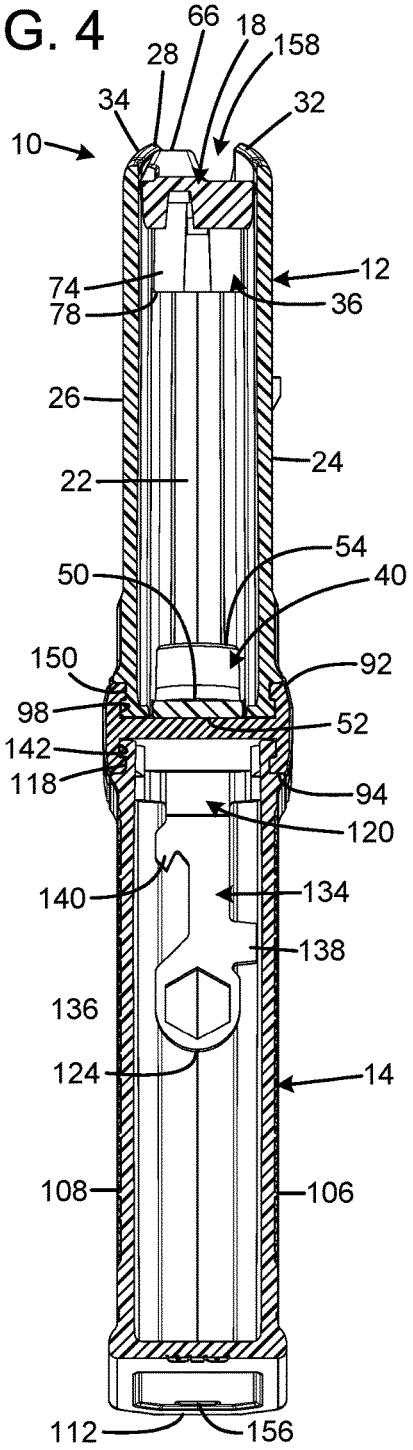
FIG. 4 is a sectional view taken along lines 4-4 of FIG. 2.
Figure 5:
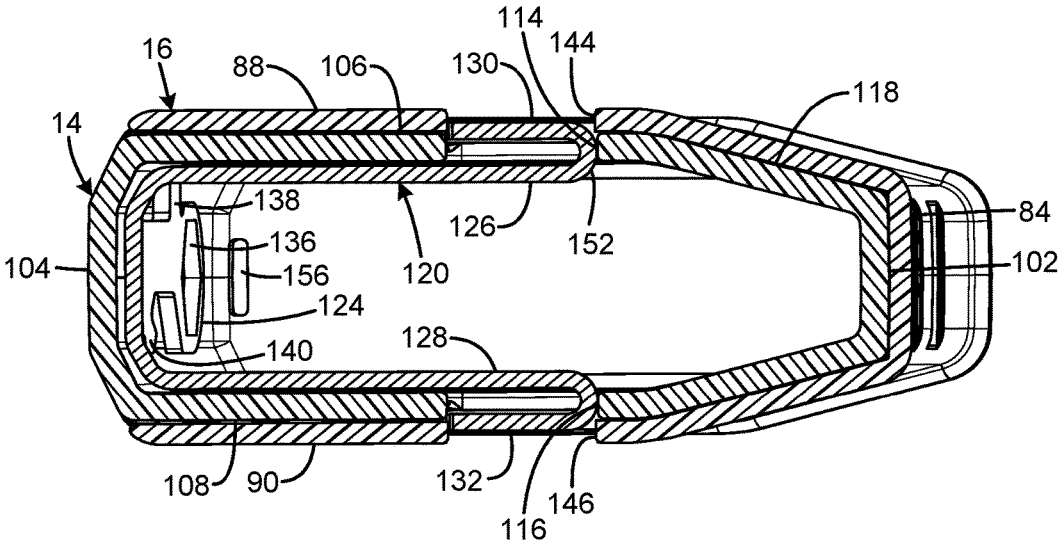
FIG. 5 is a sectional view taken along lines 5-5 of FIG. 2 with the retainer clip arms securing the storage compartment body to the bottom of the double-sided baseplate.
Figure 6:
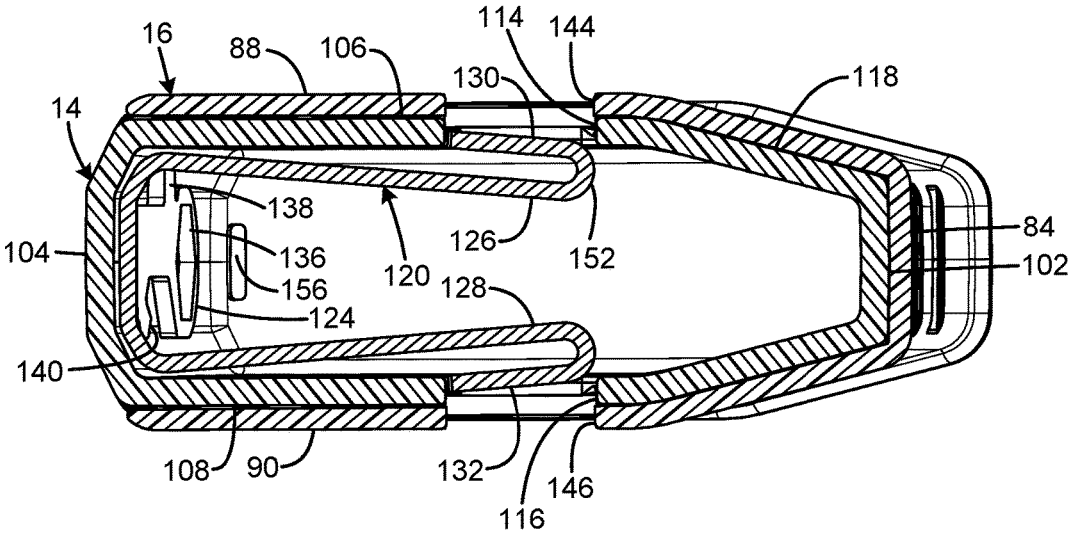
FIG. 6 is the same sectional view as FIG. 5, but with the retainer clip arms cammed inward for removal of the storage compartment body from the bottom of the double-sided baseplate.

An embodiment of the rifle magazine with storage container of the present invention is shown and generally designated by the reference numeral 10.

FIGS. 1-9 illustrate the improved rifle magazine with storage container 10 of the present invention. More particularly, the rifle magazine with storage container 10 has a magazine body 12 and a storage container body 14 that are releasably connected together by a double-sided base plate/floor plate 16. The rifle magazine with storage container 10 is of similar form as a conventional thirty round Mil-Spec magazine and can be carried in any magazine pouch compatible with conventional thirty round Mil-Spec magazines. The magazine body 12 is a first elongated tubular body defining a central bore/ammunition passage 18 that has a front 20, rear 22, left side 24, right side 26, top 28, and bottom/lower end 30. The top rear of the body includes left and right feed lips 32, 34 that define an ammunition feed aperture 158. Thus, the magazine body is an upper magazine portion adapted to retain ammunition and dispense ammunition to a magazine-fed firearm (not shown). The bottom of the body defines a groove/first floor plate attachment facility 150 that extends around the perimeter of the right, front, and left sides, and is not present on the rear.

The bottom 30 of the magazine body 12 is open to receive a follower 36, a rectangular coil spring 38, and a spring plate/spring retention element 40 within the central bore/ammunition passage 18. The spring plate has a front 42, rear 44, left side 46, right side 48, top 50, and bottom 52. The top 50 includes an upwardly protruding spring support 54 that supports and guides the coil spring. The bottom 52 includes a downwardly protruding button/latch protrusion 148 (shown in FIG. 3). The coil spring biases the follower towards the upper end of the magazine body and is compressed when the magazine body is loaded with cartridges 56.

The follower 36 has a front 58, rear 60, left side 62, right side 64, top 66, and bottom 68. The follower has a central platform portion 70 with front and rear tines 72, 74 extending perpendicularly downward from the bottom of the platform portion. The front and rear tines each have a free end 76, 78. The bottom of the follower defines a central passage 160 that bifurcates the underside of the follower.

The rectangular coil spring 38 has a top 80 and a bottom 82. The top of the coil spring fits within the central passage 160. The bottom of the coil spring receives the spring support 54, which allows the coil spring to remain centered in relationship to the bottom of the magazine.

The double-sided base plate/floor plate 16 is an elongated body that releasably closes the bottom end 30 of the magazine body 12 and secures the follower 36, rectangular coil spring 38, and spring plate 40 within the central bore 18 of the magazine body. The double-sided base plate has a front 84, rear 86, left side 88, right side 90, top 92, bottom 94, and defines a central aperture/latch aperture 96. The top of the double-sided base plate defines a groove/first attachment feature/first linear channel 98 that extends around the perimeter of the right, front, and left sides, and is not present on the rear. As a result, the bottom (bottom edge portion) 30 of the magazine body can be slid forward from the rear of the double-sided base plate until the front 20, left side 24, and right side 26 bottom edges of the magazine body are received in the groove, and the downwardly protruding button on the bottom 52 of the spring plate is received by the central aperture. In this condition, the top of the double-sided base plate is securely attached to the bottom of the magazine body, which prevents movement of the double-sided base plate with respect to the magazine body until the button on the bottom of the spring plate is depressed to remove the button from the central aperture. Once the button is disengaged from the central aperture, the magazine body can be pulled rearward to detach the double-sided base plate from the bottom of the magazine body.

In the current embodiment, the magazine body 12 has a maximum capacity of ten 5.56×45 NATO or .223 caliber rounds and is physically limited to a capacity of ten rounds. Limiting the magazine body's capacity to ten rounds makes the rifle magazine with storage container 10 legal for use in all fifty US states and prevents the rifle magazine with storage container from being subject to any legal limitations regarding the use of high-capacity magazines. The follower 36 and spring plate 40 are adapted to keep ten cartridges straight and aligned within the central bore 18 of the magazine body to allow for proper feeding into an AR-15 rifle. However, the rifle magazine with storage container 10 can also be adapted for use with any desired rifle or other firearm.

The storage container body 14 is a second elongated tubular body defining a central bore/storage passage 100 and has a front 102, rear 104, left side 106, right side 108, top 110, and bottom 112. The top rear of the storage container body defines a left cut out 114 and a right cut out 116. The top of the storage container body defines a groove/second floor plate attachment facility 118 that extends around the perimeter of the front, rear, left side, and right side. The top of the storage container body is open to receive a retainer clip 120 and any desired items within the central bore, such as survival kit 120 shown, or a first aid kit, ammunition, or additional tools. The bottom rear of the storage container body defines a drainhole 156 (shown in FIG. 10) to enable liquid to drain out. The drainhole can be easily covered by a user's finger so the storage container body can be used to purify water for drinking.

The retainer clip/spring latch 120 has a top 122, bottom 124, left side 126, right side 128, front 152, and rear 154. The top front of the retainer clip includes a left spring arm 130 and a right spring arm 132 that are releasably received within the left cut out 114 and right cut out 116 in the top 110 of the storage container body 16, respectively. The left and right spring arms extend outwards beyond the groove 118 at the top of the storage container body. The bottom rear portion of the retainer clip that extends below the left and right spring arms is a tools portion 134. In the current embodiment, the bottom of the tools portion is a ⅜" hexagonal wrench aperture 136 for use on optics or mounts, the left side of the tools portion forms a heavy straight blade screwdriver 138, and the right side of the tools portion forms a bottle opener 140. Although the tools portion is a substantially planar element in the current embodiment, the tools portion can be adapted to form any desired tool capable of fitting within the central bore 100.

Figure 7:
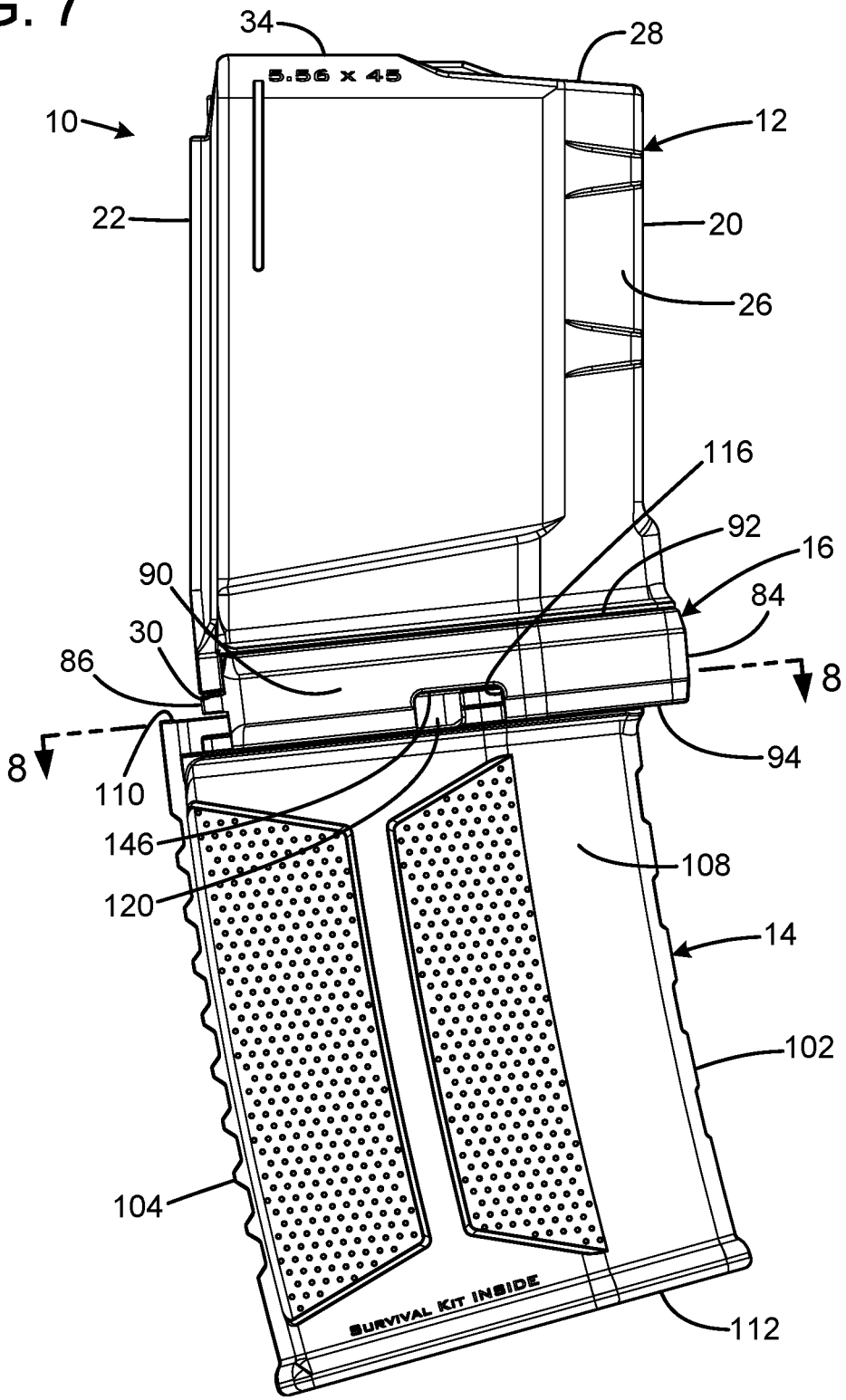
FIG. 7 is a right side view of the rifle magazine with storage container of FIG. 1 in the process of attaching the storage container body to the bottom of the double-sided baseplate.
Figure 8:
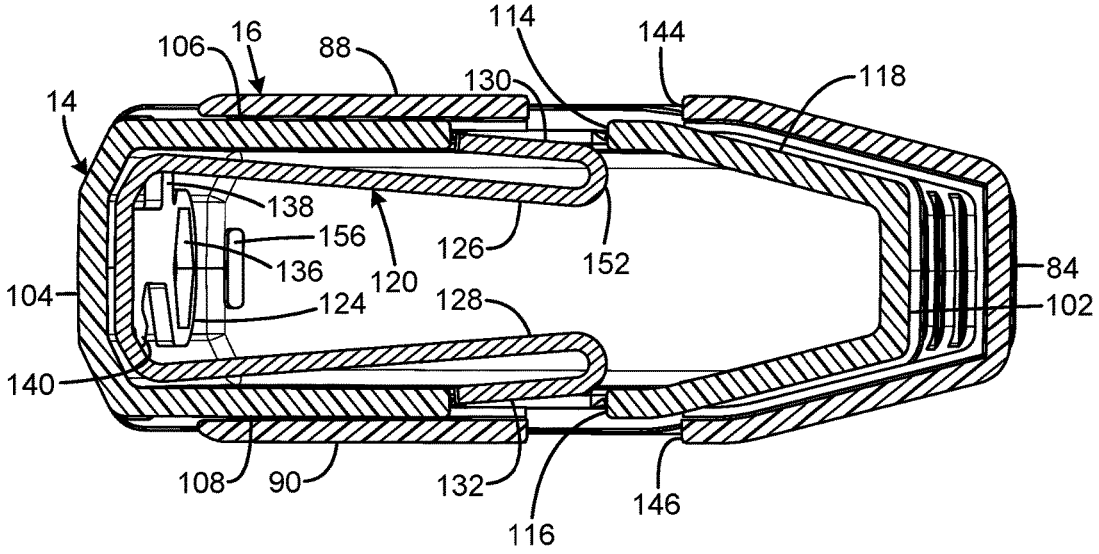
FIG. 8 a sectional view taken along lines 8-8 of FIG. 7 with the retainer clip arms cammed inward for attaching the storage container body to the bottom of the double-sided baseplate.
Figure 9:
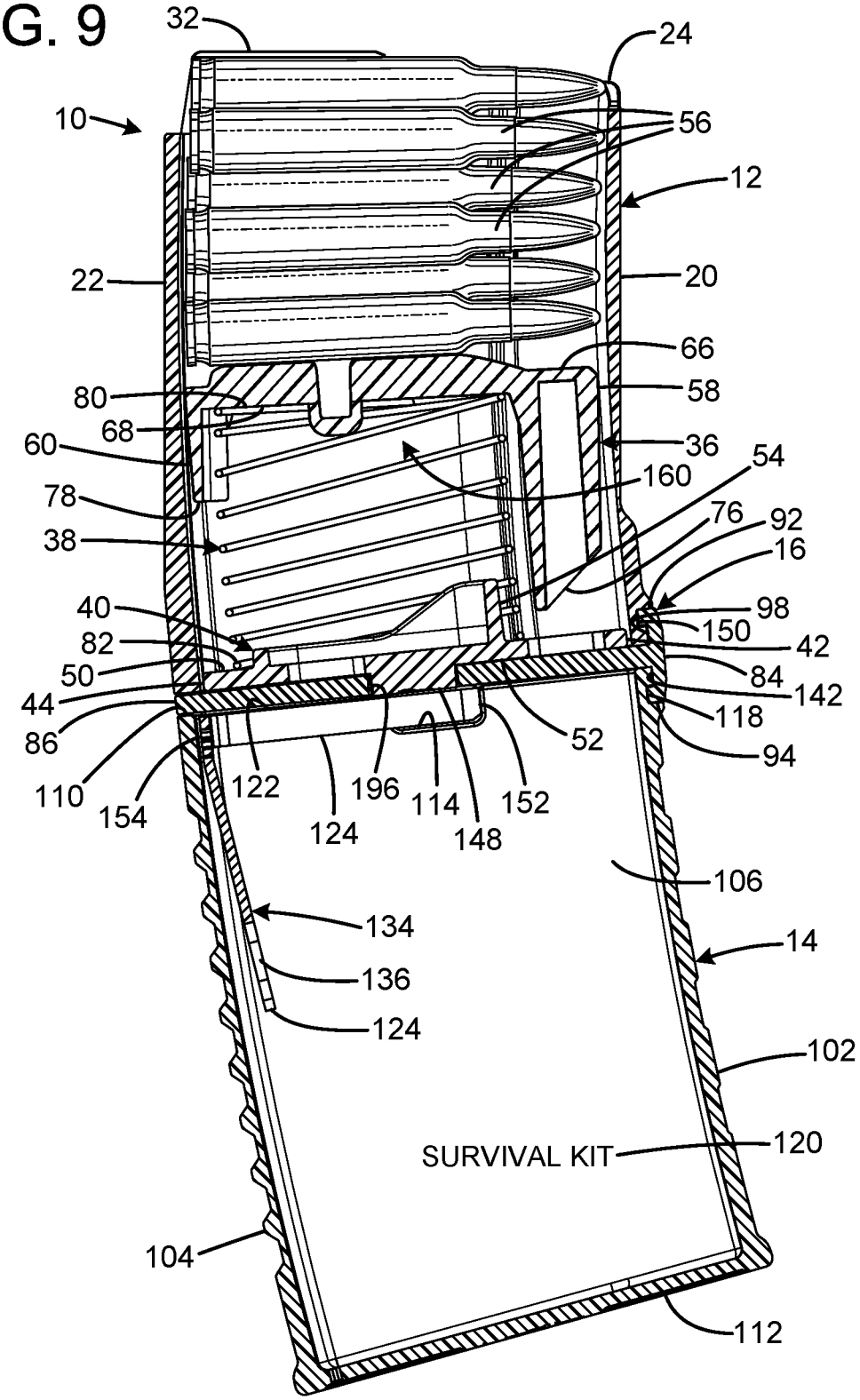
FIG. 9 is an additional view of the preferred embodiment of the invention.

The double-sided base plate/floor plate 16 releasably closes the top end 122 of the storage container body 16 and secures the retainer clip 120 and any other desired items, such as survival kit 120, within the central bore 100 of the storage container body. The bottom 94 of the double-sided base plate defines a groove/second attachment feature/second linear channel 142 that extends around the perimeter of the front 84, left 88, and right 90 sides, and is not present on the rear 86. As a result, the top (top edge portion) 110 of the storage container body can be slid forward from the rear of the double-sided base plate as shown in FIG. 7 until the front 102, left side 106, and right side 108 top edges of the storage container body are received in the groove (shown in FIG. 2). The bottom rear of the double-sided base plate defines a left cut out 144 and a right cut out 146 that are axially registered with the left and right cut outs 114, 116 in the top of the storage container body when the front, left side, and right side top edges of the storage container body are fully received in the groove 142. The outwardly protruding left and right spring arms 130, 132 cam inward (shown in FIG. 8) and then spring outward into the left and right cut outs 144, 146 in the double-sided spring plate (shown in FIG. 5) as the front, left side, and right side top edges of the storage container body are pushed forward into full engagement with the groove 142 (the engaged position). In this condition, the bottom of the double-sided base plate is securely attached to the top of the storage container body until the left and right spring arms are sufficiently depressed/cammed inwards (the actuated position shown in FIG. 6) to remove the left and right spring arms from the left and right cut outs 144, 146. Once the left and right spring arms are disengaged from the left and right cut outs 144, 146, the storage container body can be pulled rearward to detach the double-sided base plate from the top of the storage container body. Thus, the storage container body is a lower magazine portion removably connected to the upper magazine portion and defining a storage chamber.

Figure 10:
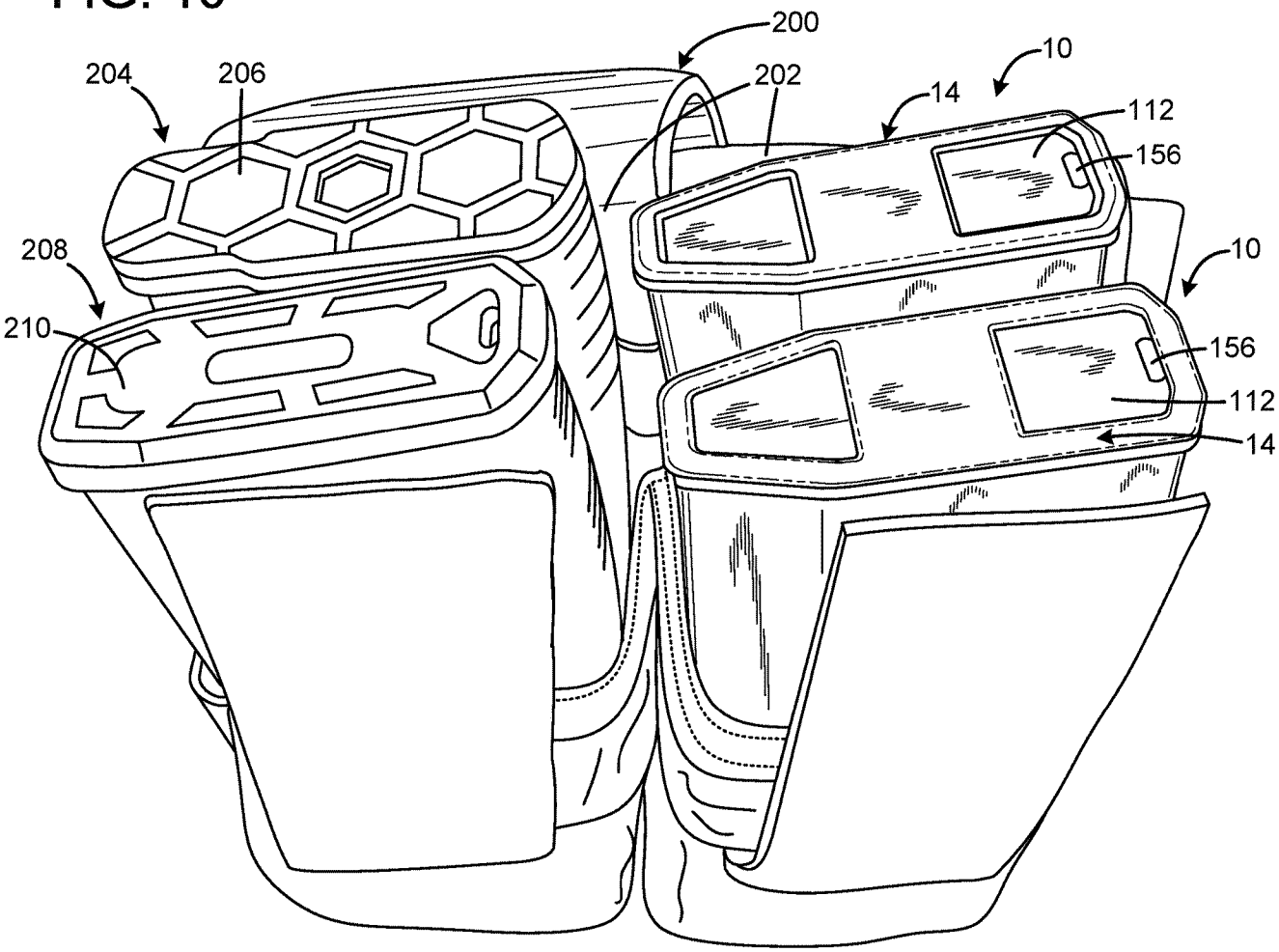
FIG. 10 is an additional view of the preferred embodiment of the invention.

FIG. 10 illustrates the improved rifle magazine with storage container 10 of the present invention. More particularly, two rifle magazines with storage container 10 are shown inserted in a conventional magazine pouch 200 for thirty round magazines. The magazine pouch has two compartments 202. The compartment on the right side of the drawing holds two rifle magazines with storage container 10, which are adapted to have the form of an elongated magazine having a consistent profile along its length, such that it may be received in the conventional magazine pouch compartments. The compartment on the left side of the drawing holds two prior art thirty round capacity magazines 204, 208. The bottoms 112 of the rifle magazines with storage container 10 are visible with drainholes 156. The bottoms 206 and 210 of the prior art thirty round capacity magazines are also visible. Both the prior art thirty round capacity magazines and the rifle magazines with storage container 10 can also be inserted into the compartments bottoms down.

It should be appreciated that the magazine body 12 remains fully functional as a rifle magazine as long as the top 92 of the double-sided base plate 16 remains attached to the bottom 30 of the magazine body, regardless of whether the top 110 of the storage container body 14 is attached to the bottom 94 of the double-sided base plate. Furthermore, the retainer clip 120 can be removed from the central bore 100 and left and right cut outs 114, 116 of the storage container body when the storage container body is detached from the double-sided base plate so the tools portion 134 can be utilized by a user as desired. After use, the retainer clip is replaced within the central bore of the storage container body with the left and right spring arms 130, 132 in the left and right cutouts 114, 116 prior to reattaching the top of the storage container body to the bottom of the double-sided baseplate. In the current embodiment the magazine body and the storage container body have a common cross-section with end apertures that are registered with each other.

In the context of the specification, the terms "rear" and "rearward," and "front" and "forward" have the following definitions: "rear" or "rearward" means in the direction away from the muzzle of the firearm while "front" or "forward" means it is in the direction towards the muzzle of the firearm.

While a current embodiment of a rifle magazine with storage container has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, although a curved magazine body and storage container body have been disclosed, the magazine body and storage container body can also be straight and not curved, like pistol magazines and some rifle magazines.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A firearm magazine comprising:

a first elongated tubular body defining an ammunition passage;

the first elongated tubular body having an upper end defining an ammunition feed aperture;

the first elongated tubular body having a lower end having a first floor plate attachment facility;

a magazine spring and follower contained in the ammunition passage;

a floor plate having a first attachment feature adapted to connect to the first floor plate attachment facility;

a second elongated tubular body separate from the first elongated tubular body and defining a storage passage;

the second elongated tubular body having an upper end having a second floor plate attachment facility;

the second tubular elongated body lacking an ammunition feed aperture; and the floor plate having a second attachment feature adapted to connect to the second floor plate attachment facility.

2. The firearm magazine of claim 1 wherein the first elongated tubular body and the second elongated tubular body have a common cross-section.

3. The firearm magazine of claim 1 wherein the first elongated tubular body and the second elongated tubular body have end apertures registered with each other.

4. The firearm magazine of claim 1 wherein the first elongated tubular body and the second elongated tubular body are adapted to have the form of an elongated magazine having a consistent profile along its length, such that it may be received in a conventional magazine pouch.

5. The firearm magazine of claim 1 wherein the floor plate is an elongated body defining a first linear channel adapted to receive a bottom edge portion of the first elongated tubular body, and having a second linear channel adapted to receive a top edge portion of the second elongated tubular body.

6. The firearm magazine of claim 1 wherein the floor plate defines a latch aperture, and including a spring retention element received within the first elongated tubular body, and captured between the magazine spring and the floor plate, the spring retention element having a latch protrusion received in the latch aperture to prevent movement of the floor plate with respect to the first elongated tubular body.

7. The firearm magazine of claim 1 including a spring latch connected to the floor plate and movable between an engaged position in which the second tubular body is secured to the floor plate and an actuated position in which the second tubular body is removable from the floor plate.

8. A firearm magazine comprising:

an upper magazine portion adapted to retain ammunition and dispense ammunition to a magazine-fed firearm;

a lower magazine portion removably connected to the upper magazine portion and defining a storage chamber;

the lower magazine portion being detachable from the upper magazine portion;

the lower magazine portion being configured to hold things other than ammunition; and the lower magazine portion having an access aperture proximate the upper magazine portion and enclosed by the upper magazine portion when the lower magazine portion is connected to the upper magazine portion.

9. The firearm magazine of claim 8 wherein the upper magazine portion and the lower magazine portion have a common cross-section.

10. The firearm magazine of claim 8 wherein the upper magazine portion and the lower magazine portion have end apertures registered with each other.

11. The firearm magazine of claim 8 wherein the upper magazine portion and the lower magazine portion are adapted to have the form of an elongated magazine having a consistent profile along its length, such that it may be received in a conventional magazine pouch.

12. The firearm magazine of claim 8 including a floor plate interconnecting the upper magazine portion and the lower magazine portion.

13. The firearm magazine of claim 8 wherein the floor plate is an elongated body defining a first linear channel adapted to receive a bottom edge portion of the upper magazine portion, and having a second linear channel adapted to receive a top edge portion of the lower magazine portion.

14. The firearm magazine of claim 8 wherein the floor plate defines a latch aperture, and including a spring retention element received within the upper magazine portion, and captured between a magazine spring and the floor plate, the spring retention element having a latch protrusion received in the latch aperture to prevent movement of the floor plate with respect to the upper magazine portion.

15. The firearm magazine of claim 14 including a spring latch connected to the floor plate and movable between an engaged position in which the lower magazine portion is secured to the floor plate and an actuated position in which the lower magazine portion is removable from the floor plate.

* * * * *